United States Patent [19]

Brannock

[11] Patent Number: 4,462,129

[45] Date of Patent: Jul. 31, 1984

[54] STABILIZED MATTRESS BORDER

[75] Inventor: Paul H. Brannock, Lilburn, Ga.

[73] Assignee: Simmons U.S.A., Atlanta, Ga.

[21] Appl. No.: 467,543

[22] Filed: Feb. 17, 1983

[51] Int. Cl.[3] ..... A47C 23/053

[52] U.S. Cl. ..... 5/474; 5/464; 5/477; 267/105; 267/111

[58] Field of Search ..... 5/464, 474, 477, 451; 267/95, 100, 101, 105, 110, 111

[56] References Cited

U.S. PATENT DOCUMENTS

| | | | |
|---|---|---|---|
| 1,371,362 | 3/1921 | Giese | 5/464 |
| 4,245,362 | 1/1981 | Mueller | 5/451 |
| 4,245,363 | 1/1981 | Callaway | 5/451 |
| 4,429,427 | 2/1984 | Sklar | 5/474 |

FOREIGN PATENT DOCUMENTS

| | | | |
|---|---|---|---|
| 496756 | 4/1930 | Fed. Rep. of Germany | 5/474 |

*Primary Examiner*—Alexander Grosz

[57] ABSTRACT

A stabilized mattress border is provided which eliminates undesirable leaning. The border defines a center compartment within which air, flotation, or spring mattress inserts may be positioned. It includes a pair of rows of pocketed coils and a flat wire positioned above and between the rows. The flat wire is attached to the upper convolutions of each of the coils and exerts an inward force upon the entire mattress border. Additional border wires are provided near the exterior corners of the mattress border as well as inside the innermost row of pocketed coils. The appropriate padding and upholstery define the compartment within which the border coils and wires are positioned.

8 Claims, 3 Drawing Figures

STABILIZED MATTRESS BORDER

BACKGROUND OF THE INVENTION

1. Field of the Invention

The field of the invention relates to a border assembly defined by rows of coil springs and including stabilizing means for preventing undesirable leaning.

2. Brief Description of the Prior Art

Certain mattress constructions are characterized by a border which defines a central compartment. U.S. Pat. No. 4,245,363, which issued Jan. 20, 1981, is an example of such a construction. It includes a plurality of coil springs arranged in a rectangular compartment which surrounds a flexible bag adapted to hold water. Border wires are provided at each corner of the rectangular compartment. An additional border wire is positioned against the middle of the interior wall thereof. The border wire at the upper interior corner is flat to reduce the possibility of its being felt from the surface of the bed.

Border compartments have been employed in non-flotation mattress constructions. In one such construction, the center of the mattress includes a pair of removable mattress inserts. The inserts may each have a different firmness. Alternatively, one of the inserts may be a spring-supported structure while the other is supported by air or water.

In either of the above types of mattresses, it is important that the border does not lean outwardly. Since it should allow an individual to sit comfortably thereon, it must provide the necessary support for this use.

SUMMARY OF THE INVENTION

A mattress border construction is provided which has the necessary stability for avoiding undesirable leaning. It includes a plurality of rows of coils and at least one flat wire positioned above and between the rows. The flat wire is attached by means of hog rings or the like to the upper convolution of each coil. Its dimensions are selected such that it exerts an inward force upon the entire border construction.

Additional border wires may be provided along each of the outer corner portions of the border. A further border wire may be positioned intermediate the ends of the innermost row of coils. Each of these border wires may be round.

The necessary padding and upholstery define the outer portions of the border and insure the comfort of one seated thereon. A padded ticking may be secured by means of a zipper or other fastening means.

DETAILED DESCRIPTION OF THE INVENTION

Figure 1:
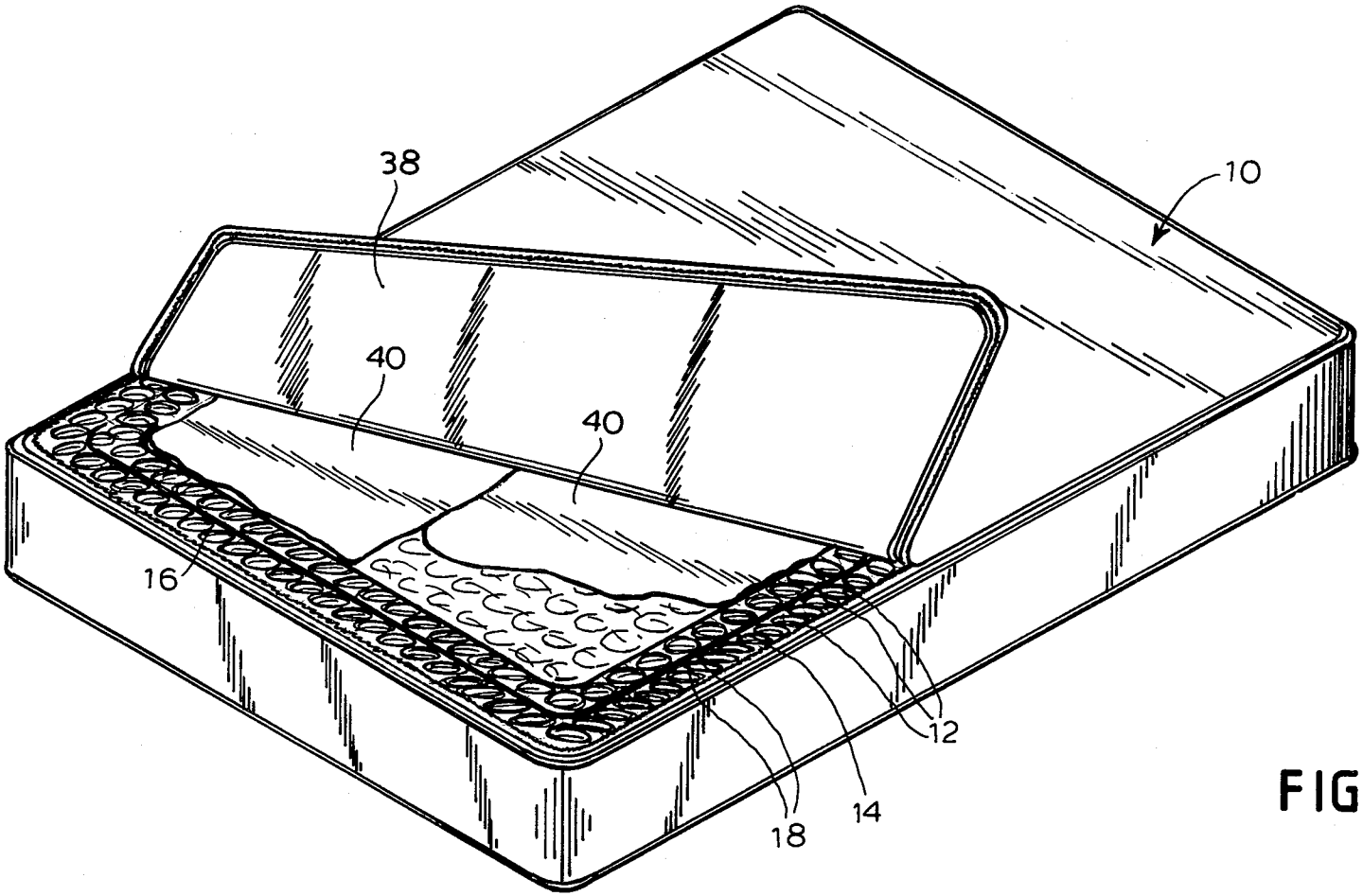
FIG. 1 is a perspective view of a mattress and mattress border construction according to the invention.
Figure 2:
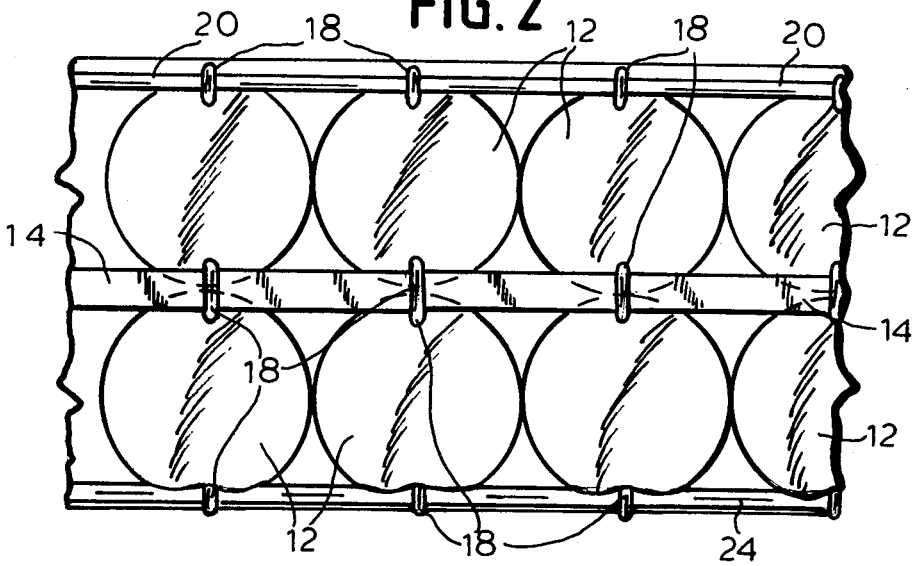
FIG. 2 is a top view of a portion of the mattress border.

A border portion 10 including a plurality of rows of pocketed coil springs 12 is provided by the invention. Each of the springs is encased within a pocket formed in a two-ply strip of thermally weldable material. The rows are joined in a manner described in U.S. Pat. No. 4,234,984 which is incorporated by reference herein. A non-nested configuration is accordingly provided. The invention, however, is applicable to both nested and non-nested rows of coils.

A flat wire 14 having its largest surfaces in the horizontal plane extends about the entire border portion 10. Clips 16 are provided for joining individual segments thereof. The flat wire 14 is positioned above the pocketed coil springs 12 and is attached to the top convolutions thereof by means of hog rings 18. The circumference of the flat wire is of course dependent upon the circumference of the border portion 10. It is selected such that its exerts an inward force thereon. Since the flat wire is positioned only above the rows of coil springs 12, the border portion will lean slightly inwardly in the absence of a flotation unit or other type of insert therein.

Three additional border wires are provided within the border portion 10. One 20 is positioned near the top outer corner thereof and a second 22 near the bottom outer corner. The third wire 24 is positioned within the innermost coil intermediate the ends thereof. Each of the additional border wires is round in cross section. Border wire 20 is secured to the uppermost convolutions of the outer row of coils while wire 22 is secured to the bottom convolutions. Hog rings 18 are employed for this purpose.

Border wire 24 is secured to intermediate convolutions of the innermost row of pocketed coils. Hog rings 18 are again employed for attachment purposes.

A foam pad 26 is provided about the entire circumference of the border portion 10. For purposes of clarity, it is only shown in FIG. 3. It rests upon the flat border wire 18 and the tops of the pocketed coil springs 12. When the border portion 10 is fully assembled, the foam pad is compressed.

Figure 3:
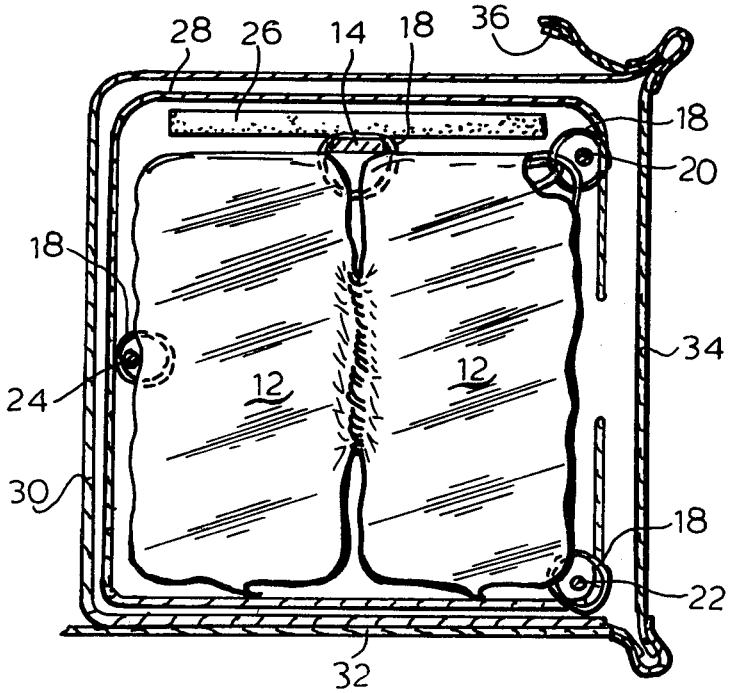
FIG. 3 is a side elevation view of the interior of the mattress border.

A C-shaped foam piece 28, again shown only in FIG. 3, forms an enclosure for the pocketed coil springs 12, border wires 14, 20-24, and the foam pad 26. Additional layers 30, 32, 34 of upholstery are provided to enclose the entire border portion 10 and to present an attractive appearance. These layers are shown as widely separated in the drawing only for purposes of illustration.

A zipper 36 or other fastening means may be provided for attaching a padded ticking 38 to the border portion 10. As shown in FIG. 1, the ticking 38 overlies both the border portion and a pair of mattress inserts 40 to provide a mattress having a conventional appearance. When the inserts 40 are removed, the border portion 10 will lean inwardly due to the force exerted by the flat border wire 14. This force is not so great as to create difficulty in replacing the inserts within the central cavity. Upon such replacement, the border portion will be perpendicular to the supporting surface.

What is claimed is:

1. A border assembly for a mattress or the like, comprising:

inner and outer rows of coils arranged side by side and defining a border;

a central cavity defined by said border;

a flat border wire positioned above and between said inner and outer rows of coils, the larger surfaces of said flat wire being in a plane perpendicular to the axes of said coils;

means connecting said flat wire to the upper portions of at least a plurality of said coils, the circumference of said flat border wire being such that the border wire exerts an inward force on the border assembly, whereby the border assembly will lean slightly inwardly in the absence of a mattress positioned in said central cavity.

2. A border assembly as defined in claim 1 wherein said inner and outer rows define a square, non-nested arrangement of coils.

3. A border assembly as defined in claim 2 including second, third, and fourth border wires, said second border wire being secured to an upper convolution of a plurality of said outer coils, said third border wire being secured to a lower convolution of a plurality of said outer coils, and said fourth border wire being secured to an intermediate convolution of a plurality of said inner coils.

4. A border assembly as defined in claim 3 including a foam pad positioned over said flat border wire and said rows 5. A border assembly as defined in claim 2 including only one inner and one outer rows of coils.

6. A border assembly as defined in claim 2 wherein said rows of coils are interconnected pocketed coils.

7. A border assembly as defined in claim 1 including a mattress positioned within said central cavity.

8. A border assembly as defined in claim 1 wherein said flat border wire is secured to the uppermost convolutions of substantially all of said coils.

* * * * *